US007573355B2

(12) United States Patent
Soora

(10) Patent No.: US 7,573,355 B2
(45) Date of Patent: Aug. 11, 2009

(54) INTEGRATED BANDPASS/BANDSTOP COUPLED LINE FILTER

(75) Inventor: Shruthi Soora, Raleigh, NC (US)

(73) Assignee: Harris Corporation, Melbourne, FL (US)

( * ) Notice: Subject to any disclaimer, the term of this patent is extended or adjusted under 35 U.S.C. 154(b) by 112 days.

(21) Appl. No.: 11/653,345

(22) Filed: Jan. 16, 2007

(65) Prior Publication Data

US 2008/0169887 A1 Jul. 17, 2008

(51) Int. Cl.
*H01P 1/20* (2006.01)

(52) U.S. Cl. ..... 333/202; 333/204; 333/238

(58) Field of Classification Search ..... 333/202, 333/204–205, 238, 246
See application file for complete search history.

(56) References Cited

U.S. PATENT DOCUMENTS

| | | | | |
|---|---|---|---|---|
| 5,187,459 | A | 2/1993 | Russell et al. | |
| 5,900,308 | A | 5/1999 | Koike et al. | |
| 6,252,476 | B1 | 6/2001 | Maloratsky | |
| 6,559,741 | B2 | 5/2003 | Takeda | |
| 6,914,497 | B2 | 7/2005 | Sano et al. | |
| 2002/0180569 | A1 | 12/2002 | Mongia | |
| 2003/0222732 | A1 | 12/2003 | Matthaei | |
| 2004/0257173 | A1 * | 12/2004 | Luque | 333/204 |
| 2005/0140473 | A1 * | 6/2005 | Jun et al. | 333/204 |
| 2005/0190016 | A1 | 9/2005 | Wung et al. | |

OTHER PUBLICATIONS

Chiou, Yi-Chyun, et al., "Periodic Stepped-Impedance Resonator (PSIR) Bandpass Filters with Multispurious Suppression," IEEE MTT-S Symposium Planar Filters with Extended Stopband, Session WE1A, Jun. 14, 2006, pp. 349-352.

Liu, A.Q., et al., "Broad-Band Band-Pass and Band-Stip Filters with Sharp Cut-off Frequencies Based on Series CPW Stubs," IEEE MTT-S Symposium Planar Filters with Extended Stopband, Session WE1A, Jun. 14, 2006, pp. 353-356.

Tu, Wen-Hua, et al., "Microstrip Open-Loop Bandpass Filter Using Open Stubs for Harmonic Suppression," IEEE MTT-S Symposium Planar Filters with Extended Stopband, Session WE1A, Jun. 14, 2006, pp. 357-360.

(Continued)

*Primary Examiner*—Anh Q Tran
(74) *Attorney, Agent, or Firm*—Sheppard, Mullin, Richter & Hampton LLP

(57) ABSTRACT

An apparatus and method for attenuating selected frequency bands in a microstrip filter having a plurality of microstrip resonators. The filter comprises plural resonators, a first of the plural resonators is operatively connected to a first feed point and a second of the plural resonators is operatively connected to a second feed point. A third of the plural resonators is a half wavelength resonator and may be operatively connected to the first, second and/or other plural resonators. The third resonator may also comprise a plurality of resonators whereby the position and number of the third resonator is a function of a predetermined rejected frequency range.

37 Claims, 5 Drawing Sheets

OTHER PUBLICATIONS

Lin, Shih-Cheng, et al., "Dual Quarter-Wavelength Hairpin Bandpass Filter with Multiple Transmission Zeros," IEEE MTT-S Symposium Planar Filters with Extended Stopband, Session WE1A, Jun. 14, 2006, pp. 361-364.

Hong, Seungpyo, et al., "A Parallel-Coupled Microstrip Bandpass Filter With Suppression of Both the $2^{nd}$ and the $3^{rd}$ Harmonic Responses," IEEE MTT-S Symposium Planar Filters with Extended Stopband, Session WE1A, Jun. 14, 2006, pp. 365-368.

Mao, Shau-Gang, et al., "Compact Composite Right/Left-handed Coplanar Waveguide Filters with Arbitrary Passband and Stopband Responses," IEEE MTT-S Symposium Planar Filters with Extended Stopband, Session WE1A, Jun. 14, 2006, pp. 369-372.

Gu, Jianzhong, et al., "Miniaturization and Harmonic Suppression Open-loop Resonator Bandpass Filter with Capacitive Terminations," IEEE MTT-S Symposium Planar Filters with Extended Stopband, Session WE1A, Jun. 14, 2006, pp. 373-376.

PCT International Search Report and Written Opinion dated Jul. 8, 2008 for International Application No. PCT/US08/51090.

* cited by examiner

INTEGRATED BANDPASS/BANDSTOP COUPLED LINE FILTER

BACKGROUND

Filters are commonly utilized in the processing of electrical signals. For example, in communications applications, such as microwave applications, it is desirable to filter out the smallest possible passband and thereby enable dividing a fixed frequency spectrum into the largest possible number of bands.

Historically, filters have fallen into three broad categories. First, lumped element filters utilize separately fabricated air wound inductors and parallel plate capacitors, wired together to form a filter circuit. These conventional components are relatively small compared to the wave length, and thus provide a compact filter. However, the use of separate elements has proved to be difficult to manufacture, resulting in large circuit to circuit variations. The second conventional filter structure utilizes three-dimensional distributed element components. These physical elements are sizeable compared to the wavelength. Coupled bars or rods are used to form transmission line networks which are arranged as a filter circuit. Ordinarily, the length of the bars or rods is one quarter or one half of the wavelength at the center frequency of the filter. Accordingly, the bars or rods can become quite sizeable, often being several inches long, resulting in filters over a foot in length. Third, printed distributed element filters have been used. Generally, they comprise a single layer of metal traces printed on an insulating substrate, with a ground plane on the back of the substrate. The traces are arranged as transmission line networks to make a filter. Again, the size of these filters can become quite large. These filters also suffer from various responses at multiples of the center frequency.

The parallel-coupled microstrip bandpass filter is a commonly used filter and has been widely utilized in the last few decades because of its planar structure, simple design and implementation, and wide bandwidth range. In high frequency circuit sections, such as the RF stage of transmitter and receiver circuits for communication systems, microstrip bandpass filters are often used to attenuate harmonics radiation caused by the nonlinearity in amplifier circuits. Microstrip filters are also commonly employed to eliminate undesired signal waves such as interfering waves, sidebands, etc. from the desired signal waves. When utilizing a common antenna for both the transmitter and the receiver circuits, microstrip filters may also separate the transmitter frequency band and the receiver frequency band.

FIG. 1 is an illustration of a traditional prior art bandpass filter. With reference to FIG. 1, a multi-resonator bandpass filter 100 comprises a plurality of quarter wavelength ($\lambda/4$) sequentially coupled microstrip lines 111-115. Generally, prior art bandpass filters utilize straight microstrip lines; however, the bandpass filter may also utilize bent microstrip lines commonly referred to as hairpin transmission lines or hairpin resonators. FIG. 2 is a graph of the frequency response of the prior art bandpass filter of FIG. 1 having a passband of 10.24 GHz to 11.78 GHz. With reference to FIG. 2, the return loss 202 and insertion loss 203 characteristics of the prior art bandpass filter are shown where the measured minimum loss in the passband was approximately −9.871 dB at 10.24 GHz and −9.713 dB at 11.78 GHz. To reduce spurious passbands at the harmonics of the center frequency, the specific frequency range of 21.28 GHz to 23.12 GHz should be attenuated. Additionally, to reduce any passbands resulting from spurious or undesired signals, the frequency range of 15.96 GHz to 17.34 GHz should also be attenuated. The measured minimum loss at these frequency ranges in the traditional prior art bandpass filter was approximately −39.795 dB at 15.96 GHz and −42.586 dB at 17.34 GHz and −21.046 dB at 21.28 GHz and −28.690 dB at 23.12 GHz.

As illustrated in FIG. 2, the traditional parallel-coupled microstrip bandpass filter, however, possesses spurious passbands at the harmonics of the designed center frequency ($f_o$). This greatly limits the use of the parallel-coupled microstrip bandpass filters in broadband systems operating over a frequency bandwidth including the second and third harmonics of the designed center frequency of a filter. Since modern communication systems utilize wider bandwidth and filters are essential components within these systems, there exists a need in the art to overcome this problem.

Further prior art methods and apparatuses have attempted to address these problems with typical parallel-coupled microstrip bandpass filters. Several prior art methods include providing different electrical path lengths for the even and odd modes to suppress the second harmonic passband, utilizing a uniplanar compact photonic-bandgap structure to reject both the second and third harmonic passbands, and utilizing wiggly-line bandpass filters. These prior art techniques, however, require a complex circuit design and/or alter the physical size of the filter to pass desired signals without producing significant distortion or to sufficiently attenuate interfering signals outside the passband.

Techniques for directly realizing a bandpass filter having ideal filter characteristics, based on a clear design procedure, are not known in the prior art, and it is thus common practice to construct filters empirically by mixture of various known techniques. For example, bandpass filters for communication applications are generally realized and constructed as filter circuits having the desired passband/stopband characteristics by connecting series or parallel resonant circuits employing various circuit elements in a plurality of stages. In many cases, filter circuit blocks are constructed by unbalanced distributed constant transmission lines such as coupled microstrip lines or patch resonators, because they provide good electrical characteristics for high frequency circuits, and are small in size as circuit elements.

A need exists in the art for compact, reliable, and efficient microstrip filters capable of suppressing the second and third harmonic passbands. Accordingly, there is a need for a method and apparatus for a novel microstrip bandpass resonator that would overcome the deficiencies of the prior art. Therefore, an embodiment of the present subject matter provides a microstrip filter comprising a first microstrip resonator operatively connected to a first feed point, a second microstrip resonator operatively connected to a second feed point, and a third microstrip resonator operatively connected to the first or second resonator, wherein said third resonator is a half wavelength ($\frac{1}{2}\lambda$) resonator. The third resonator may further comprise a plurality of resonators wherein the position thereof with respect to the first or second resonators being a function of a predetermined rejected frequency range.

Another embodiment of the present subject matter provides a method for rejecting spurious frequency bands in a microstrip filter. The method comprises the steps of operatively connecting a first microstrip resonator to a first feed point, operatively connecting a second microstrip resonator to a second feed point, and operatively connecting a third microstrip resonator to the first or second resonator wherein the third resonator is a $\frac{1}{2}\lambda$ resonator. The third resonator may further comprise a plurality of resonators wherein the position thereof with respect to the first or second resonators being a function of a predetermined rejected frequency range. An alternative embodiment may further comprise the steps of operatively connecting one of the plural resonators on one side of the first resonator, and operatively connecting another of the plural resonators on an opposite side of the first resonator. An additional embodiment of the present subject matter may comprise the step of operatively connecting one of the plural resonators to the second resonator and/or operatively connecting one of the plural resonators between the first and second resonators.

A further embodiment of the present subject matter provides a microstrip filter comprising a first microstrip resonator operatively connected to a first feed point, a second microstrip resonator operatively connected to a second feed point, and at least one ½λ resonator operatively connected to the first or second resonator. The position and number of the at least one ½λ resonator are a function of a predetermined rejected frequency range.

An additional embodiment of the present subject matter provides a method for attenuating selected frequency bands in a microstrip filter having a plurality of microstrip resonators. The method comprises the steps of providing a first of the plural resonators operatively connected to a first feed point, providing a second of the plural resonators operatively connected to a second feed point, and operatively connecting a third of the plural resonators to the first or second resonator wherein the third resonator is a ½λ resonator. The third resonator may further comprise a plurality of resonators wherein the position thereof with respect to the first or second resonators being a function of a predetermined rejected frequency range. An alternative embodiment may further comprise the steps of operatively connecting one of the plural resonators on one side of the first resonator, and operatively connecting another of the plural resonators on an opposite side of the first resonator. An additional embodiment of the present subject matter may comprise the step of operatively connecting one of the plural resonators to the second resonator and/or operatively connecting one of the plural resonators between the first and second resonators.

These embodiments and many other objects and advantages thereof will be readily apparent to one skilled in the art to which the invention pertains from a perusal of the claims, the appended drawings, and the following detailed description of the embodiments.

DETAILED DESCRIPTION

With reference to the figures where like elements have been given like numerical designations to facilitate an understanding of the present subject matter, the various embodiments of a method and apparatus for filtering a selected frequency band are herein described.

Figure 1:
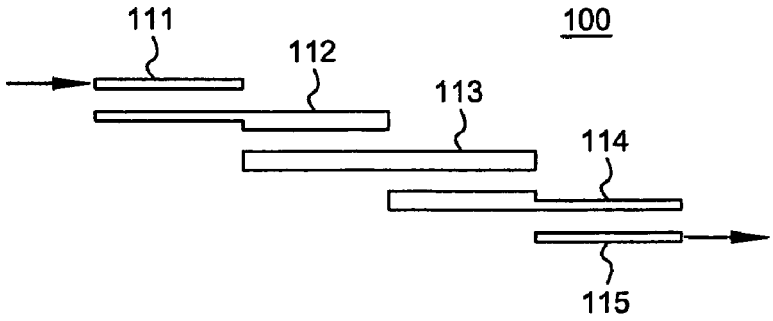
Figure 1 Prior Art
FIG. 1 is an illustration of a prior art bandpass filter.
Figure 2:
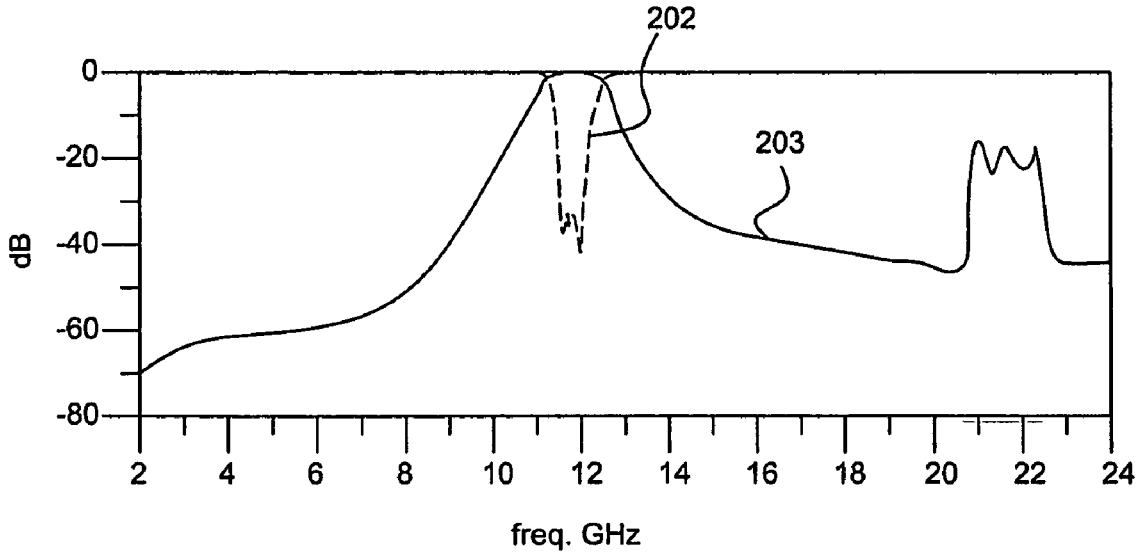
Figure 2 Prior Art
FIG. 2 is a graph of the frequency response of the prior art bandpass filter of FIG. 1.
Figure 3:
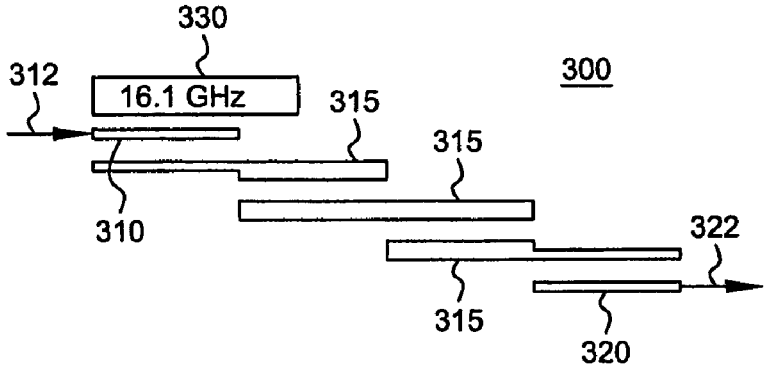
FIG. 3 is an illustration of a microstrip filter according to an embodiment of the present subject matter.

FIG. 3 is an illustration of a microstrip filter according to an embodiment of the present subject matter. With reference to FIG. 3, a microstrip filter 300 comprises a plurality of microstrip resonators. A first of the microstrip resonators 310 may be operatively connected to a first feed point 312 and a second of the microstrip resonators 320 may be operatively connected to a second feed point 322. The first feed point 312 may provide a signal (not shown) to the filter 300 and the second feed point 322 may provide a filtered output signal (not shown) to external components. Of course, the second feed point may provide an input signal and the first feed point may provide a filtered output signal.

While FIG. 3 illustrates three microstrip resonators 315 operatively connected between the first and second resonators 310, 320, any number of microstrip resonators may be connected therebetween and such an illustration should not limit the scope of the claims appended herewith. A third of the microstrip resonators 330 may be operatively connected to the first resonator 310 and placed in sufficient proximity thereto ensuring the highest coupling between the first and third resonators 310, 330. As shown, the third resonator 330 is a half wavelength (½λ) resonator having a center frequency of 16.1 GHz. The position of the third resonator 330 in relation to the first resonator 310 increases the attenuation at the 15.96 GHz to 17.34 GHz frequency range. Of course, the third resonator 330 may be operatively connected to the second resonator 320 or other plural resonators 315. The embodiment of the present subject matter illustrated in FIG. 3 is scalable to all microwave frequency applications such as, but not limited to, a transmitter, a receiver, a transceiver, etc. and the bandstop capabilities may be modified to wide ranges of desired frequencies without interrupting the bandpass characteristics of the microstrip filter 300.

Figure 4:
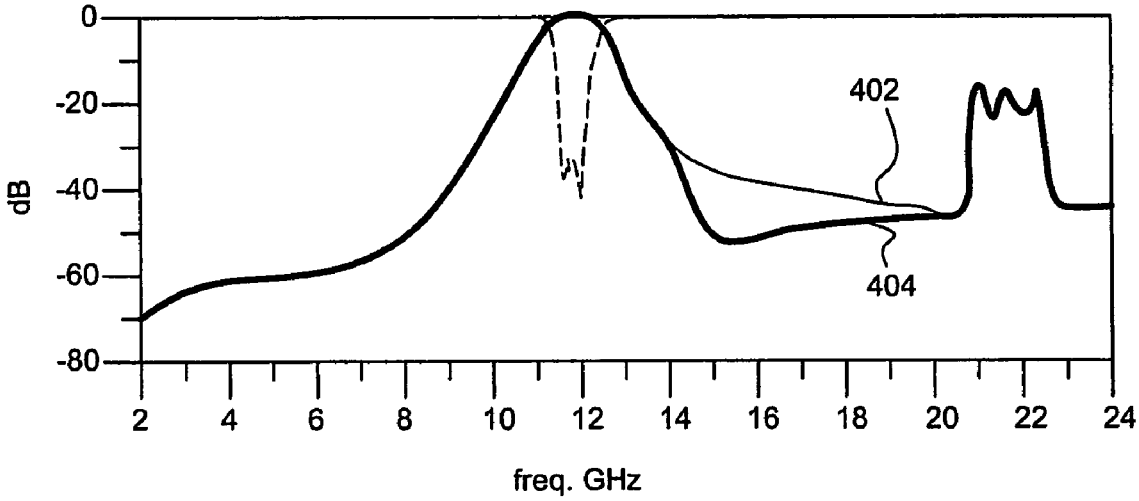
FIG. 4 is a graph of the frequency response of the microstrip filter of FIG. 3.

FIG. 4 is a graph of the frequency response of the microstrip filter of FIG. 3. With reference to FIG. 4, a frequency response of a traditional bandpass filter 402 and a microstrip filter according to an embodiment of the present subject matter 404 are shown. As illustrated, through integration of the third resonator 330 in the microstrip filter 300, the attenuation increases in the 15.96 GHz to 17.34 GHz frequency range without significantly modifying the passband characteristics. The measured minimum loss at this frequency range was approximately −51.445 dB at 15.98 GHz to −47.621 dB at 17.35 GHz in comparison to approximately −39.795 dB at 15.96 GHz and −42.586 dB at 17.34 GHz for the traditional prior art bandpass filter. Thus, the third resonator 330 acts as a bandstop filter in a desired frequency range without significantly increasing the complexity of the overall filter or increasing the size of the filter. While specific frequencies are shown in FIG. 4, such an illustration is not intended to limit the scope of the claims appended herewith and embodiments of the present subject matter may be utilized with a wide range of frequencies. For example, the rejected frequency range may be altered by modifying the length of the third resonator 330.

Figure 5:
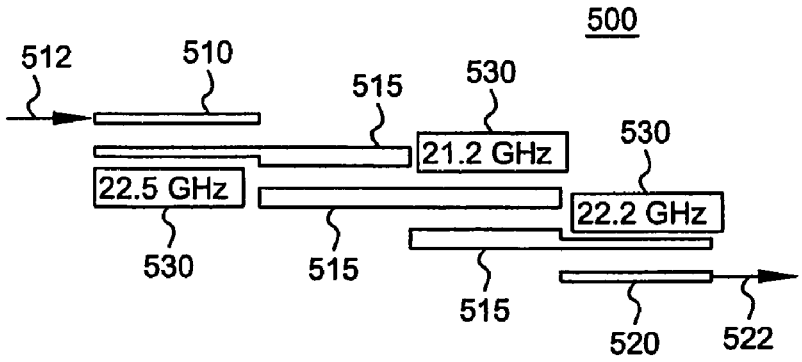
FIG. 5 is an illustration of a microstrip filter according to a further embodiment of the present subject matter.

FIG. 5 is an illustration of a microstrip filter according to a further embodiment of the present subject matter. With reference to FIG. 5, a microstrip filter 500 comprises a plurality of microstrip resonators. A first of the microstrip resonators 510 may be operatively connected to a first feed point 512 and a second of the microstrip resonators 520 may be operatively connected to a second feed point 522. The first feed point 512 may provide a signal to the filter 500 and the second feed point 522 may provide a filtered output signal to external components. Of course, the second feed point may provide an input signal and the first feed point may provide a filtered output signal.

While FIG. 5 illustrates three additional microstrip resonators 515 operatively connected between the first and second resonators 510, 520, any number of microstrip resonators may be connected therebetween and such an illustration should not limit the scope of the claims appended herewith. A plurality of the microstrip resonators 530 may be operatively connected to the first resonator 510, second resonator 520 and additional resonators 515. The plural resonators 530 are placed in sufficient proximity to the adjacent microstrip resonators to ensure the highest coupling therebetween. As shown, the plural resonators 530 are ½λ resonators having center frequencies of 21.2 GHz, 22.5 GHz, and 22.2 GHz. The position of the plural resonators 530 in relation to their respective adjacent resonators increases the attenuation at the 21.28 GHz to 23.12 GHz frequency range. The embodiment of the present subject matter illustrated in FIG. 5 is scalable to all microwave frequency applications such as, but not limited to, a transmitter, a receiver, a transceiver, etc., and the bandstop capabilities may be modified to wide ranges of desired frequencies without interrupting the bandpass characteristics of the microstrip filter 500.

Figure 6:
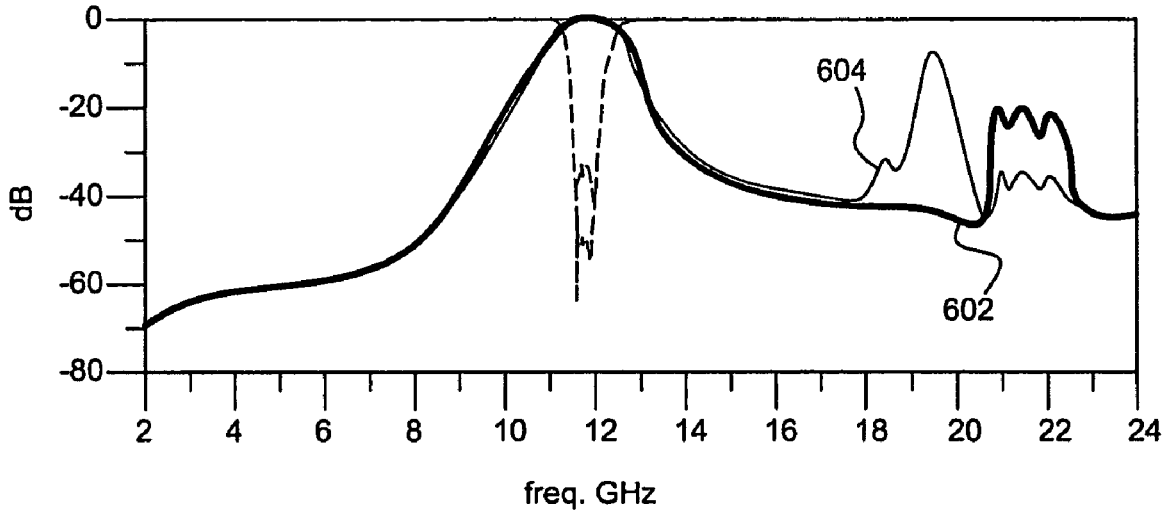
FIG. 6 is a graph of the frequency response of the microstrip filter of FIG. 5.

FIG. 6 is a graph of the frequency response of the microstrip filter of FIG. 5. With reference to FIG. 6, a frequency response of a traditional bandpass filter 602 and a microstrip filter according to an embodiment of the present subject matter 604 are shown. As illustrated, through integration of the plural resonators 530 in the microstrip filter 500, the attenuation increases in the 21.28 GHz to 23.12 GHz frequency range without significantly modifying the passband characteristics. The measured minimum loss at this frequency range was approximately −37.201 dB at 21.27 GHz to −36.085 dB at 23.13 GHz in comparison to approximately −21.046 dB at 21.28 GHz and −28.690 dB at 23.12 GHz for the traditional prior art bandpass filter. Thus, the plural resonators 530 act as bandstop filters in a desired frequency range without significantly increasing the complexity of the overall filter or increasing the size of the filter. While specific frequencies are shown in FIG. 6, such an illustration is not intended to limit the scope of the claims appended herewith and embodiments of the present subject matter may be utilized with a wide range of frequencies. For example, the rejected frequency ranges may be altered by modifying the length of any one or a plurality of the resonators 530.

Figure 7:
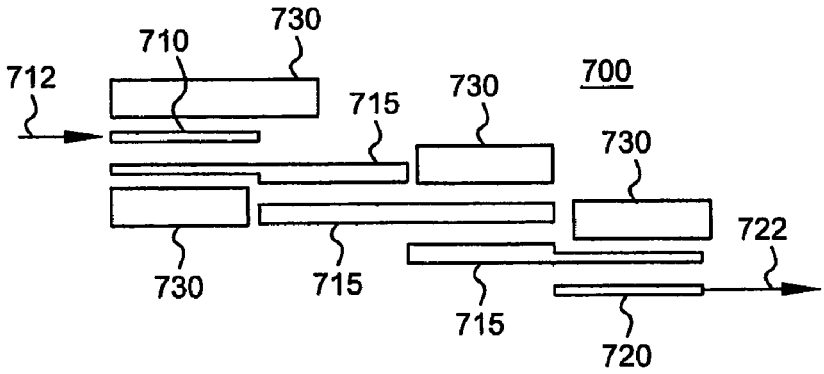
FIG. 7 is an illustration of a microstrip filter according to another embodiment of the present subject matter.

FIG. 7 is an illustration of a microstrip filter according to another embodiment of the present subject matter. With reference to FIG. 7, a microstrip filter 700 comprises a plurality of microstrip resonators. A first of the microstrip resonators 710 may be operatively connected to a first feed point 712 and a second of the microstrip resonators 720 may be operatively connected to a second feed point 722. The first feed point 712 may provide a signal to the filter 700 and the second feed point 722 may provide a filtered output signal to external components. Of course, the second feed point may provide an input signal and the first feed point may provide a filtered output signal.

While FIG. 7 illustrates three additional microstrip resonators 715 operatively connected between the first and second resonators 710, 720, any number of microstrip resonators may be connected therebetween and such an illustration should not limit the scope of the claims appended herewith. A plurality of the microstrip resonators 730 may be operatively connected to the first resonator 710, second resonator 720 and additional resonators 715. The plural resonators 730 are placed in sufficient proximity to the adjacent microstrip resonators to ensure the highest coupling therebetween. As shown, the plural resonators 730 are ½λ resonators having center frequencies of 16.1 GHz, 21.2 GHz, 22.5 GHz, and 22.2 GHz. The position of the plural resonators 730 in relation to their respective adjacent resonators increases the attenuation at both the 15.96 GHz to 17.34 GHz frequency range and the 21.28 GHz to 23.12 GHz frequency range. The embodiment of the present subject matter illustrated in FIG. 7 is scalable to all microwave frequency applications such as, but not limited to, a transmitter, a receiver, a transceiver, etc., and the bandstop capabilities may be modified to wide ranges of desired frequencies without interrupting the bandpass characteristics of the microstrip filter 700.

Figure 8:
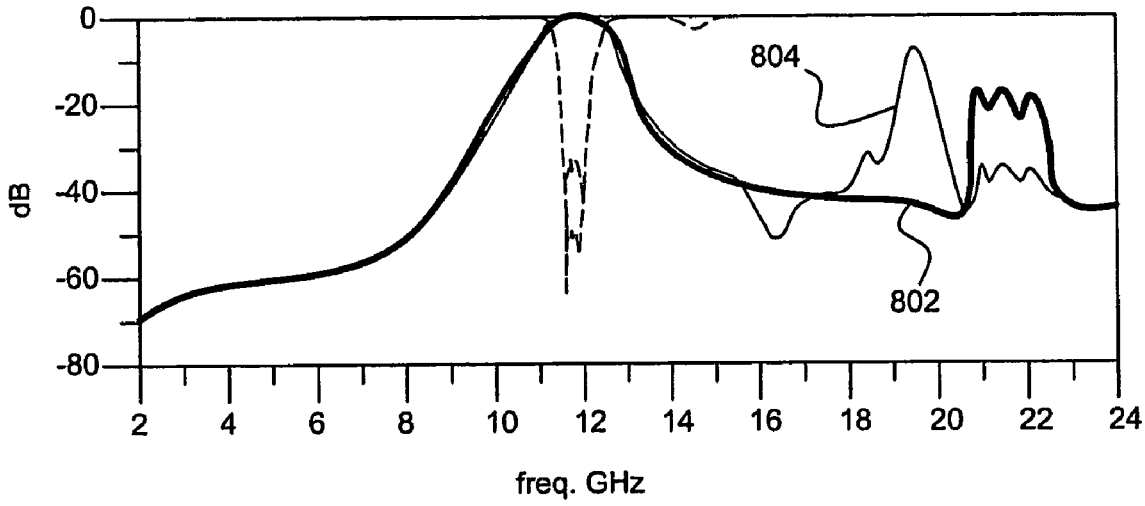
FIG. 8 is a graph of the frequency response of the microstrip filter of FIG. 7.

FIG. 8 is a graph of the frequency response of the microstrip filter of FIG. 7. With reference to FIG. 8, a frequency response of a traditional bandpass filter 802 and a microstrip filter according to an embodiment of the present subject matter 804 are shown. As illustrated, through integration of the plural resonators 730 in the microstrip filter 700, the attenuation increases in both the 15.96 GHz to 17.34 GHz frequency range and the 21.28 GHz to 23.12 GHz frequency range without significantly modifying the passband characteristics. The measured minimum loss at these frequency ranges was approximately −57.803 dB at 16.06 GHz to −47.282 dB at 17.35 GHz and −37.438 dB at 21.26 GHz to −36.085 dB at 23.13 GHz in comparison to approximately −39.795 dB at 15.96 GHz and −42.586 dB at 17.34 GHz and −21.046 dB at 21.28 GHz and −28.690 dB at 23.12 GHz for the traditional prior art bandpass filter. Thus, the plural resonators 730 act as bandstop filters in desired frequency ranges without significantly increasing the complexity and size of the filter. While specific frequencies are shown in FIG. 8, such an illustration is not intended to limit the scope of the claims appended herewith and embodiments of the present subject matter may be utilized with a wide range of frequencies. For example, the rejected frequency range may be altered by modifying the length of any one or a plurality of the resonators 730.

Figure 9:
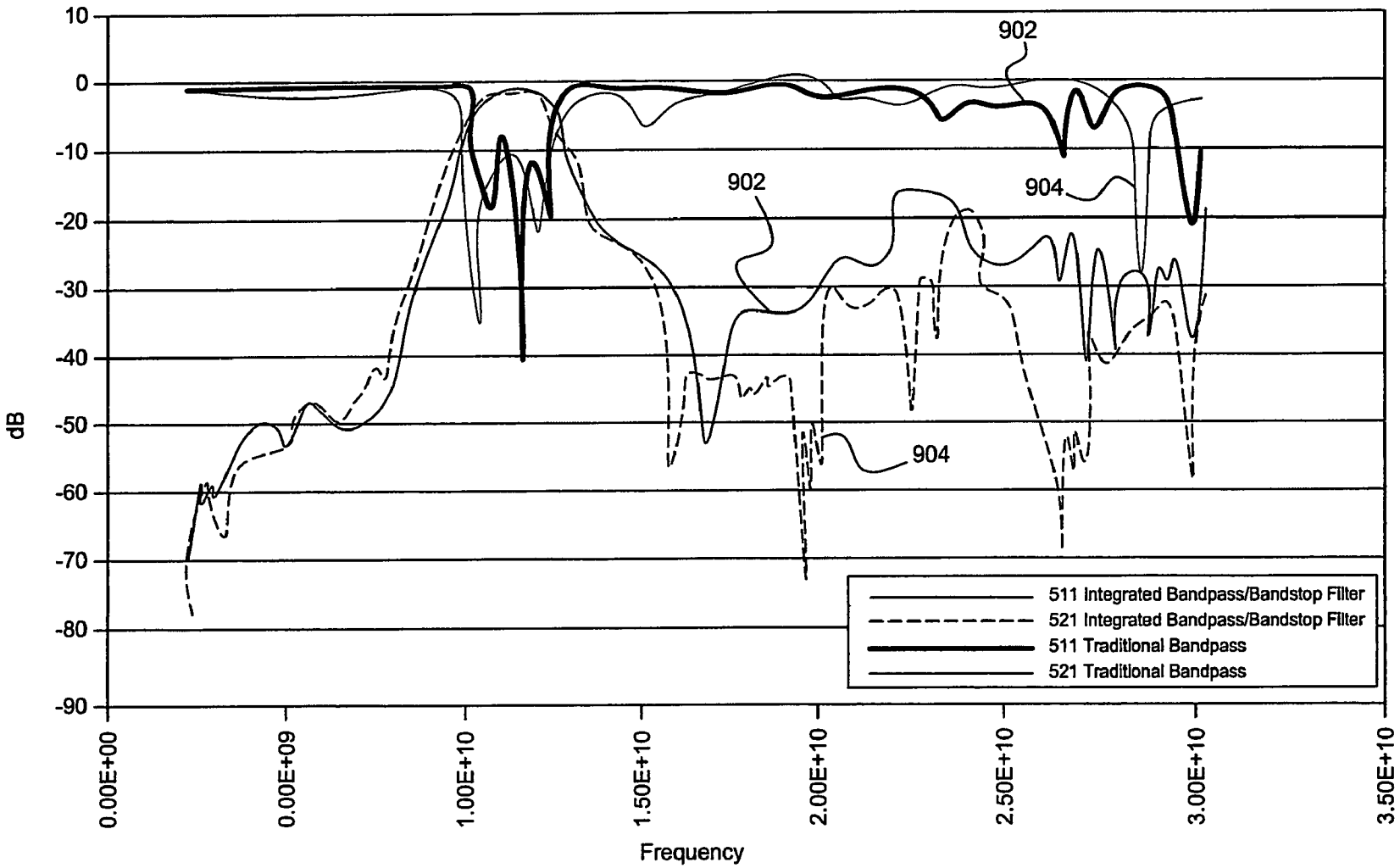
FIG. 9 is a graph comparing the frequency response of a fabricated traditional bandpass filter and a microstrip filter according to an embodiment of the present subject matter.

FIG. 9 is a graph comparing the frequency response of a fabricated traditional bandpass filter and a microstrip filter according to an embodiment of the present subject matter. The filters were fabricated on a Rogers 4350 board having a relative permittivity of 3.48. As illustrated by FIG. 9, a microstrip filter according to an embodiment of the present subject matter enhances the frequency response of a filter and attenuates spurious frequency ranges. Furthermore, such an approach provides an increased filter performance without enlarging the physical size of a respective filter. While FIG. 9 is illustrated with specific frequencies, embodiments of the present subject matter may be utilized in a wide range of frequencies.

It is thus an aspect of the present subject matter to suppress harmonics and attenuate spurious frequency regions by adding ½λ resonators for any desired frequency into a bandpass filter design. By placing the ½λ resonators above and below the coupled lines of a bandpass filter, the undesirable energy at the appropriate frequencies may be rejected by the resonator rather than transmitted through a respective communication system or apparatus such as a transmitter, receiver, transceiver or other known component or circuit utilized in a wireless network, point-to-point, point-to-multipoint radio network, etc. Thus, by attenuating the signal, the effect of certain frequency ranges may be reduced by fine tuning the filter to reject certain frequency bands. This may strengthen a filter network to reject spurious regions and harmonics. Since the resonators may be encapsulated into a microstrip filter, embodiments of the present subject matter do not add structures outside the microstrip filter's length. Thus, embodiments of the present subject matter minimize the physical size of a filter network resulting in a more efficient and cost effective design.

It is a further aspect of the present subject matter that the embodiments described herein are scalable to all microwave frequency applications and the bandstop capabilities may be modified to wide ranges of desired frequencies without interrupting the bandpass characteristics of the respective filter.

One embodiment of the present subject matter provides a microstrip filter having a first microstrip resonator operatively connected to a first feed point and a second microstrip resonator operatively connected to a second feed point. A third microstrip resonator may be operatively connected to the first or second resonator wherein the third resonator is a ½λ resonator. The third resonator may further comprise a plurality of resonators and the position of the third resonator with respect to the first or second resonators is a function of a predetermined rejected frequency range.

A further embodiment of the present subject matter provides a method for rejecting spurious frequency bands in a microstrip filter. The method comprises the steps of operatively connecting a first microstrip resonator to a first feed point, operatively connecting a second microstrip resonator to a second feed point, and operatively connecting a third microstrip resonator to said first or second resonator wherein said third resonator is a ½λ resonator. The third resonator may further comprise a plurality of resonators and the position of the third resonator with respect to the first or second resonators is a function of a predetermined rejected frequency range. An alternative embodiment of the present subject matter may further comprise the steps of operatively connecting one of the plural resonators on one side of the first resonator, and operatively connecting another of the plural resonators on an opposite side of the first resonator. An additional embodiment may include the step of operatively connecting one of the plural resonators to the second resonator. Further embodiments may include the step of operatively connecting one of the plural resonators between the first and second resonators.

An additional embodiment of the present subject matter provides a microstrip filter having a first microstrip resonator operatively connected to a first feed point, a second microstrip resonator operatively connected to a second feed point, and at least one ½λ resonator operatively connected to the first or second resonator. The position and number of the at least one ½λ resonator are a function of a predetermined rejected frequency range. The ½λ resonators may be operatively connected on one side of the first resonator and/or operatively connected on an opposite side of the first resonator. Further ½λ resonators may be operatively connected between the first and second resonators.

Another embodiment of the present subject matter provides a method for attenuating selected frequency bands in a microstrip filter having a plurality of microstrip resonators. The method comprises the steps of providing a first of the plural resonators operatively connected to a first feed point and providing a second of the plural resonators operatively connected to a second feed point. The method further comprises the step of operatively connecting a third of the plural resonators to the first or second resonator wherein the third resonator is a ½λ resonator. The third resonator may further comprise a plurality of resonators and the position of the third resonator with respect to the first or second resonators is a function of a predetermined rejected frequency range. An alternative embodiment of the present subject matter may further comprise the steps of operatively connecting one of the second plurality on one side of the first resonator, and operatively connecting another of the second plurality on an opposite side of the first resonator. Further embodiments of the present subject matter may comprise the step of operatively connecting one of the second plurality to the second resonator and/or operatively connecting one of the second plurality between the first and second resonators.

As shown by the various configurations and embodiments illustrated in FIGS. 1-9, a method and apparatus for filtering a selected frequency band have been described.

While preferred embodiments of the present subject matter have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What I claim is:

1. A microstrip filter comprising:

a first microstrip resonator operatively connected to a first feed point;

a second microstrip resonator operatively connected to a second feed point; and a third microstrip resonator operatively connected to said first or second resonator, wherein said third resonator is a half wavelength (½λ) resonator and wherein at least one of said first, second or third resonators is a hairpin resonator.

2. The filter of claim 1 wherein the position of said third resonator is a function of a predetermined rejected frequency range.

3. The filter of claim 1 wherein said third resonator further comprises a plurality of resonators.

4. The filter of claim 3 wherein the position of said plural resonators with respect to said first or second resonators are a function of a predetermined rejected frequency range.

5. The filter of claim 3 wherein one of said plural resonators connected on one side of said first resonator and another of said plural resonators is operatively connected on an opposite side of said first resonator.

6. The filter of claim 5 wherein the position of said plural resonators with respect to said first resonator are a function of a predetermined rejected frequency range.

7. The filter of claim 5 wherein one of said plural resonators is operatively connected to said second resonator.

8. The filter of claim 7 wherein the position of said one plural resonator with respect to said second resonator is a function of a predetermined rejected frequency range.

9. The filter of claim 5 wherein one of said plural resonators is operatively connected between said first and second resonators.

10. The filter of claim 9 wherein the position of said one plural resonator with respect to said first and second resonators is a function of a predetermined rejected frequency range.

11. The filter of claim 3 wherein the number of said plural resonators is a function of a predetermined rejected frequency range.

12. The filter of claim 1 wherein the length of said third resonator is a function of a predetermined rejected frequency range.

13. The filter of claim 1 wherein said filter passes a frequency range of 10.54 GHz to 11.66 GHz.

14. The filter of claim 1 wherein the rejected frequency ranges are selected from the group consisting of 15.96 GHz to 17.34 GHz and 21.28 GHz to 23.12 GHz.

15. A communication device comprising the filter of claim 1.

16. The apparatus of claim 15 wherein said communication device is selected from the group consisting of: a transmitter, a receiver, a transceiver.

17. A method for rejecting spurious frequency bands in a microstrip filter comprising the steps of:

operatively connecting a first microstrip resonator to a first feed point;

operatively connecting a second microstrip resonator to a second feed point; and operatively connecting a third microstrip resonator to said first or second resonator wherein said third resonator is a half wavelength (½λ) resonator and wherein at least one of said first, second or third resonators is a hairpin resonator.

18. The method of claim 17 wherein the position of said third resonator with respect to said first or second resonators is a function of a predetermined rejected frequency range.

19. The method of claim 17 wherein said third resonator further comprises a plurality of resonators.

20. The method of claim 19 further comprising the steps of:

operatively connecting one of said plural resonators on one side of said first resonator; and operatively connecting another of said plural resonators on an opposite side of said first resonator.

21. The method of claim 19 further comprising the step of operatively connecting one of said plural resonators to said second resonator.

22. The method of claim 19 further comprising the step of operatively connecting one of said plural resonators between said first and second resonators.

23. A microstrip filter comprising:

a first microstrip resonator operatively connected to a first feed point;

a second microstrip resonator operatively connected to a second feed point; and at least one half wavelength (½λ) resonator operatively connected to said first or second resonator;

wherein the number of said at least one ½λ resonator is a function of a predetermined rejected frequency ranger;

wherein the position of said at least one ½λ resonator with respect to said first or second resonators is a function of a predetermined rejected frequency range; and wherein at least one of said first, second or ½λ resonators is a hairpin resonator.

24. The filter of claim 23 wherein one ½λ resonator is operatively connected on one side of said first resonator and another ½λ resonator is operatively connected on an opposite side of said first resonator.

25. The filter of claim 23 wherein at least one ½λ resonator is operatively connected between said first and second resonators.

26. The filter of claim 23 wherein the length of said at least one ½λ resonator is a function of said predetermined rejected frequency range.

27. The filter of claim 23 wherein at least one of said first, second or ½λ resonators is a straight transmission line.

28. The filter of claim 23 wherein said filter passes a frequency range of 10.54 GHz to 11.66 GHz.

29. The filter of claim 23 wherein the rejected frequency ranges are selected from the group consisting of: 15.96 GHz to 17.34 GHz and 21.28 GHz to 23.12 GHz.

30. A communication device comprising the filter of claim 23.

31. The apparatus of claim 30 wherein said communication device is selected from the group consisting of: a transmitter, a receiver, a transceiver.

32. A method for attenuating selected frequency bands in a microstrip filter having a plurality of microstrip resonators comprising the steps of:

providing a first of said plural resonators operatively connected to a first feed point;

providing a second of said plural resonators operatively connected to a second feed point; and operatively connecting a third of said plural resonators to said first or second resonator wherein said third resonator is a half wavelength (½λ) resonator and wherein at least one of said first, second or ½λ resonators is a hairpin resonator.

33. The method of claim 32 wherein the position of said third resonator with respect to said first, or second resonators is a function of a predetermined rejected frequency range.

34. The method of claim 32 wherein said third resonator further comprises a second plurality of resonators.

35. The method of claim 34 further comprising the steps of:

operatively connecting one of said second plurality on one side of said first resonator; and operatively connecting another of said second plurality on an opposite side of said first resonator.

36. The method of claim 34 further comprising the step of operatively connecting one of said second plurality to said second resonator.

37. The method of claim 34 further comprising the step of operatively connecting one of said second plurality between said first and second resonators.

* * * * *

UNITED STATES PATENT AND TRADEMARK OFFICE

CERTIFICATE OF CORRECTION

PATENT NO. : 7,573,355 B2
APPLICATION NO. : 11/653345
DATED : August 11, 2009
INVENTOR(S) : Shruthi Soora It is certified that error appears in the above-identified patent and that said Letters Patent is hereby corrected as shown below:

Column 9, line 39, "rejected frequency ranger" should be changed to --rejected frequency range--.

Column 10, line 32, "first, or second" should be changed to --first or second--.

Signed and Sealed this

Twenty-fourth Day of August, 2010

David J. Kappos

David J. Kappos
*Director of the United States Patent and Trademark Office*